United States Patent [19]

White

[11] Patent Number: 4,791,894

[45] **Date of Patent: * Dec. 20, 1988**

[54] RECIPROCATING PISTON ENGINE

[76] Inventor: Ambrose White, 713 Avenue G, Kentwood, La. 70444

[ * ] Notice: The portion of the term of this patent subsequent to Sep. 2, 2003 has been disclaimed.

[21] Appl. No.: 881,336

[22] Filed: Jul. 2, 1986

Related U.S. Application Data

[63] Continuation-in-part of Ser. No. 686,451, Dec. 26, 1984, Pat. No. 4,608,951.

[51] Int. Cl.[4] ..... F01L 1/34

[52] U.S. Cl. ..... 123/90.16

[58] Field of Search ..... 123/90.16, 90.28, 90.48, 123/90.15

[56] References Cited

U.S. PATENT DOCUMENTS

| | | | |
|---|---|---|---|
| 2,663,288 | 12/1953 | Hutchison | 123/90.16 |
| 4,433,964 | 2/1984 | Holtzberg et al. | 123/90.31 |
| 4,608,951 | 9/1986 | White | 123/90.16 |

FOREIGN PATENT DOCUMENTS

| | | | |
|---|---|---|---|
| 0101516 | 6/1984 | Japan | 123/90.16 |
| 0188007 | 10/1984 | Japan | 123/9[illegible] |
| 0922296 | 4/1982 | U.S.S.R. | 123/90.16 |
| 2017820 | 10/1979 | United Kingdom | 123/90.16 |

*Primary Examiner*—Charles J. Myhre
*Assistant Examiner*—David A. Okonsky
*Attorney, Agent, or Firm*—Llewellyn A. Proctor

[57] ABSTRACT

This invention relates to improvements in engines of the reciprocating piston type, especially reciprocating piston internal combustion engines suitable for stationary and non-stationary uses. The pistons of the engine are operatively connected to the drive shaft of the engine via an elongated gear-roller gear pinion mechanism. In association with a cylinder-piston unit of the engine there is provided a roller gear pinion, engaged with the drive shaft such that rotation thereof rotates the drive shaft. An elongated roller gear is pivotally connected via an end to a piston, and the opposite open end of said elongated roller gear is meshed with the roller gear pinion. The elongated roller gear is guided through a path via appropriate mechanism which maintains continuous contact between said gears such that reciprocation of the piston within a cylinder produces rotation of the drive shaft. The invention also relates to an improved metering device for the introduction of air, or a mixture of fuel and air into the engine.

17 Claims, 6 Drawing Sheets

RECIPROCATING PISTON ENGINE

RELATED APPLICATION

This is a continuation-in-part of application Ser. No. 686,451, filed Dec. 26, 1984, now U.S. Pat. No. 4,608,951 which issued 9/02/86.

BACKGROUND AND PROBLEMS

1. Field of the Invention

This invention relates to improvements in reciprocating piston engines. In particular, it relates to improvements in that portion of a reciprocating piston engine wherein power is delivered by the piston, or pistons, to the main drive shaft. The invention also relates to an improved metering device for the introduction of air, or a mixture of fuel and air into the engine.

2. Background and Prior Art

Reciprocating piston engines have been known for many years. In internal combustion engines, a type of reciprocating piston engine which has become widely available for both stationary and automotive uses, at least one and almost invariably a plurality of pistons are individually; reciprocably mounted within cylinders. A piston is constituted of a piston head, the crown or closed side of which faces the combustion chamber, or portion of a cylinder to which a charge of a combustible mixture, or fuel, can be admitted via a fuel injector or a carburator fed intake valve. The volume of the cylinder is varied by movement of the piston, the volume of the cylinder above the crown head of the piston expanding during the intake stroke, or piston outstroke, and decreasing during a piston exhaust stroke. The opposite side of a piston head is pivotally attached to an end of a piston shaft while the opposite end of a piston shaft is in turn operatively engaged to a crankshaft, A combustible mixture of fuel and air are fed into the closed end of a cylinder via a fuel intake valve, ignited, and burned such that the burning, expanding gases exert force against the crown side of a piston head in a power stroke, or piston outstroke to push, and move a piston within a cylinder, applying a torque to the crankshaft to perform useful work. Certain operating fundamentals are common to all internal combustion engines of the reciprocating piston type.

In the operation of an internal combustion engine an operating cycle or series of events are carried out in succession, over and over again, to make the engine run, or perform. Two-stroke and four-stroke engines are well known, the four-stroke engine being the most common. Considering, e.g., a single cycle of operation, with respect to a given cylinder of a operation of a four-stroke engine, there is included: (1) a fuel intake stroke produced by suction of fuel through an open intake valve into a closed cylinder during an outstroke of a piston, (2) a compression stroke produced by compression of the fuel attained by the instroke of a piston, (3) a power stroke attained by spark or self-ignition of the fuel charge sucked or injected into a cylinder, expansion of the burning gas pressing against the crown side of a piston head, and (4) an exhaust stroke attained by exhaust of the gases from the closed cylinder during the next instroke of a piston. These cycles are repeated ad infinitum, each cycle (i.e., intake, compression, power and exhaust stroke) producing two revolutions of the crankshaft.

The compression and power strokes are the basic and necessary strokes of the cycle of operation cf any reciprocating piston internal combustion engine. The fuel intake and exhaust strokes are eliminated in the two-stroke cycle engine by compressing the fresh fuel charge slightly outside the cylinders so that the fuel charge will flow into the cylinders through ports which are uncovered as the piston approaches the end of the power stroke. Exhaust gases are pushed out through a second set of ports in the cylinder in a scavenging step by the incoming fuel charge. It would be expected that the two-stroke cycle would provide twice as much power from an engine of given size at a given operating speed. Not so, however: the two-stroke cycle is less efficient than the four-stroke cycle becuase the four-stroke cycle provides more positive scavenging and charging of the cylinders with less loss of fuel charge to the exhaust. The two-stroke cycle, however, is somewhat more efficient in a self-ignition engine than in a spark-ignition engine because air alone is used in a self-ignition engine in scavenging the cylinders with no loss of fuel in the process.

Despite the wide availability and use of the internal combustion engine, in any event, such engines are notoriously fuel inefficient. The gasoline engine attains an efficiency of about fifteen to twenty-two percent, based on the theoretical useful energy available in a given weight, or volume of fuel. The diesel engine, one of the world's most efficient power sources, converts more of the energy contained in a given quantity of fuel into useful energy than any other power-developing engine. The future of the diesel engine thus appears assured because of its higher efficiency over an entire range of speed and load. Yet, the diesel engine is generally no more than about twenty-five to twenty-seven percent more efficient than a gasoline engine.

There presently exists a profound need for more fuel efficient reciprocating piston engines, especially internal combustion engines of the reciprocating piston type.

III. OBJECTS

It is, accordingly, a primary objective of the present invention to supply such need.

It is, in particular, an object to provide a novel more fuel efficient reciprocating piston engine suitable for both stationary and non-stationary uses, inclusive especially of self-ignited and spark-ignited internal combustion engines for railroad, marine and automotive uses, commercial and military.

A further, and more specific object is to provide a novel, more efficient clean exhaust emission engine of the internal combustion, reciprocating piston type.

IV. THE INVENTION

These objects and others are achieved in accordance with this invention which embodies principally, improvements in that portion of a reciprocating piston engine wherein power is delivered by a piston, or pistons, to the main drive shaft. It also relates to improvements in a volume metering device, or camshaft intake valve activated sub-assembly for the introduction of air, or a mixture of fuel and air into such engines.

In general, the improved power transmission embodies, in assembly with reciprocating piston engines such as described, an improved combination comprising a roller gear pinion operatively engaged with a drive shaft, and an elongated roller gear operatively engaged to said roller gear pinion and to a piston of the reciprocating piston engine. One end of the elongated roller gear is pivotally connected to a piston of a cylinder-piston unit, opposite its crown side, while the other end thereof is engaged or meshed with said roller gear pinion. Reciprocation of the piston within its cylinder will produce rotation of the drive shaft due to the application of force by the piston actuated elongated roller gear upon said roller gear pinion.

In its preferred form the roller gear pinion is concentrically mounted upon the drive shaft, and the elongated roller gear is in operative engagement with the roller gear pinion and piston. One end of the elongated roller gear is open centered, forms an elongated circle, and the inside faces thereof are provided with teeth for continuous meshing engagement with the teeth of the roller gear pinion, The elongated roller gear is also provided with a roller face, or faces, which contact, and remain in constant contact with a roller face, or faces, located on the roller gear pinion. Guide bar roller shafts are mounted on the engine near the drive shaft. The guide bar roller shafts are spaced apart, in-line one with another, and mounted in bearings in generally parallel orientation with the drive shaft, one each on alternately disposed sides of a roller gear pinion, and elongated roller gear. Guide bars, one each of which is mounted on an elongated roller gear on a side thereof faced toward said guide bar roller shafts, are engagable with an alternately disposed pair of said guide bar roller shafts. On the outstroke of a piston, as occurs during a fuel intake stroke or a power stroke, a guide bar will move between one of said pairs of guide bar roller shafts to create and maintain continuous contact between the teeth and rollers in a face of an elongated roller gear, and consequent continuous meshing and rolling engagement with the teeth and rollers on the face of a roller gear pinion, and on a piston instroke the guide bar will ride around to the opposite side of said pair of guide bar roller shafts to guide the elongated roller gear through a path which causes the continued meshing and rolling engagement between the teeth and rollers of the elongated roller gear and the teeth and rollers of the roller gear pinion to rotate the drive shaft.

The engine also includes a novel cam-camshaft activated intake valve sub-assembly which can be set to control, or regulate, the amount of air, or mixture of fuel and air taken into an engine during the intake stroke. During operation of the engine, the timing of the intake valve can thus be set and precisely regulated to open and then close over a precisely timed period, during an operating cycle of the engine, to withdraw from a carburator into a cylinder a precisely measured admixture of fuel and air, or a precisely measured amount of air to which is then added a specific quantity of fuel as via a conventional injector, to obtain more complete combustion of the fuel, More complete combustion leads to more efficient elimination of carbon monoxide which is burned to carbon dioxide and water, and there is less nitrous oxide formation which lessens pollution of the environment.

The ability of the cam-camshaft actuated intake valve mechanism to close the intake valve at any point of piston travel within a cylinder is important for several reasons. It establishes a means for the introduction of a measured amount of cylinder air intake so that a proper amount of fuel can be injected to speed up or slow down the engine; it avoids excessive expenditures of energy as in compressing too much air in a compression stroke; it provides extra space for complete burning of the air-fuel mixture during a power stroke, and converts more of the burning expanding gases into useful energy, and can lessen or eliminate the need for a muffler.

These and other features of these novel combinations in their preferred form, as well as the principle of their operation will be better understood by reference to the following drawing and detailed description which makes direct reference to this drawing. In the drawing, similar numbers are used in the different figures to represent similar parts and components, and subscripts are used with a given whole number to designate a plurality of analogous parts or components. Where subscripts are employed, and subsequent reference is made to the part or component by number without use of the subscripts, the designation is intended in a generic sense.

Figure 2:
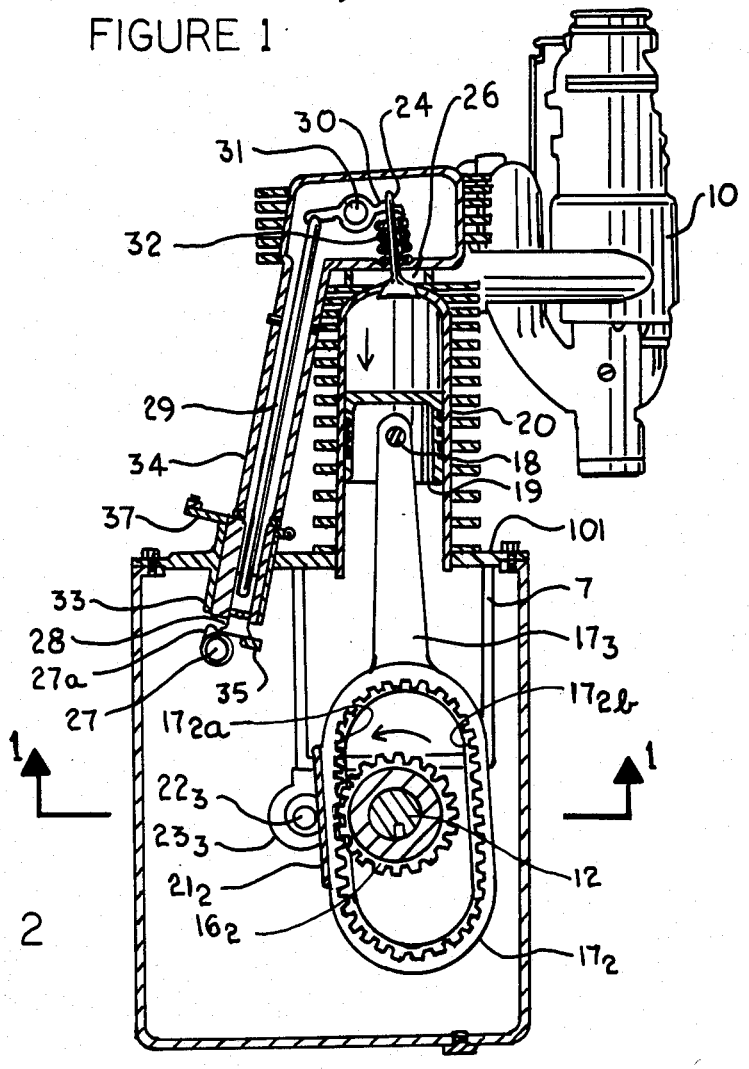
FIG. 2 is a section view taken along line 2—2 of FIG. 1.
Figure 2A:
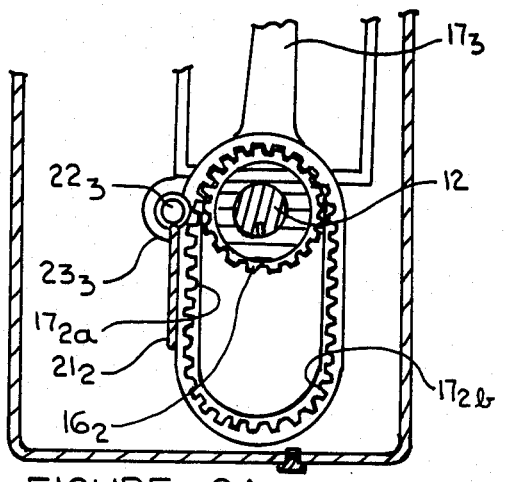
Figure 2C:
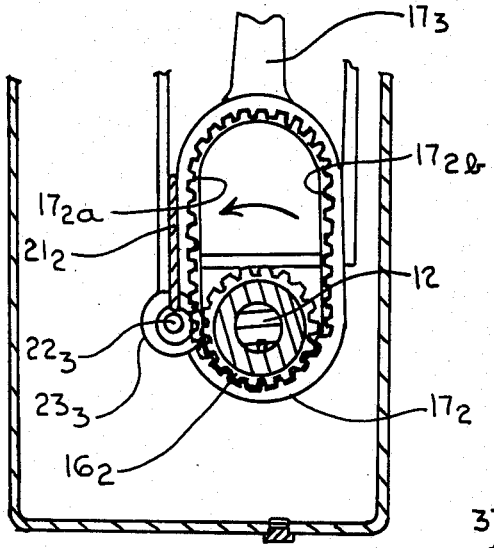
Figure 2B:
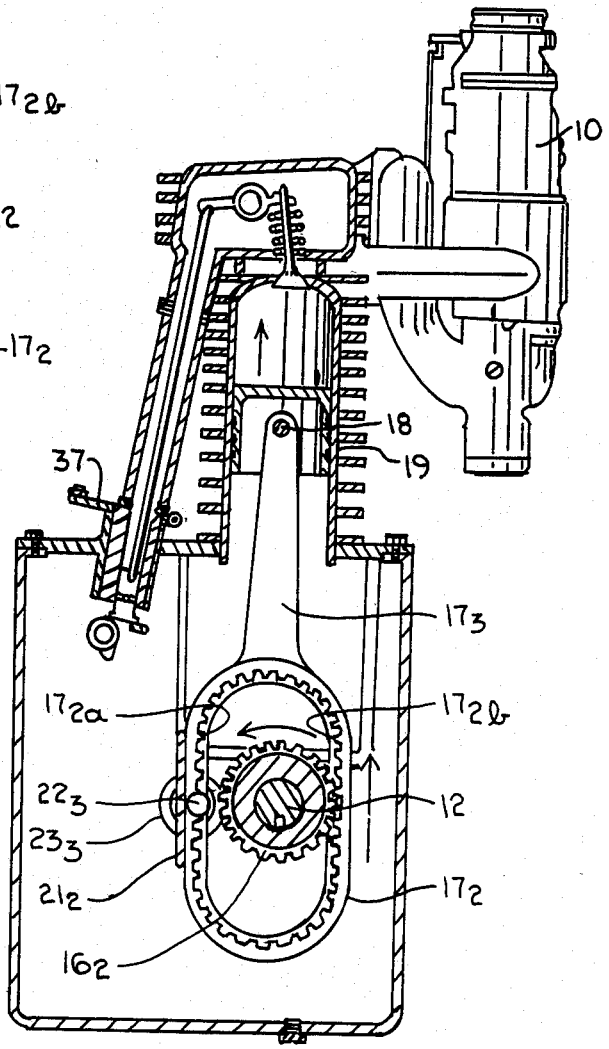

FIG. 2, taken with FIGS. 2A, 2B, and 2C depict a cycle of operation of a cylinder, and piston, as during an intake stroke, a compression stroke, a power stroke, and an exhaust stroke.

Figure 3:
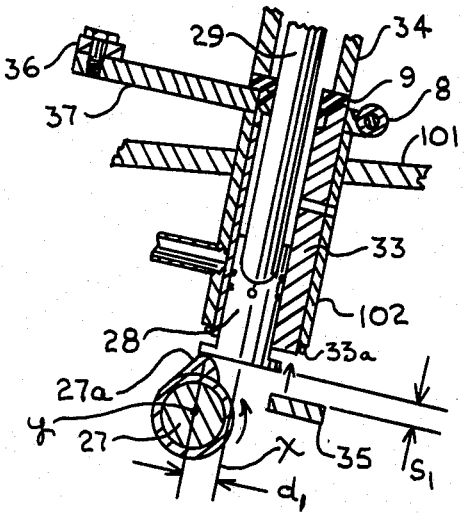
Figure 3A:
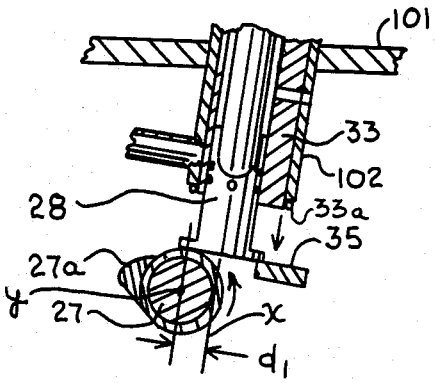

FIGS. 3 (3A), 4 (4A), and 5 are fragmentary views, in section, of the lower portion of the cam-camshaft activated inlet valves sub-assembly, or device for introducing, and metering fuel and air into a cylinder.

Figure 6:
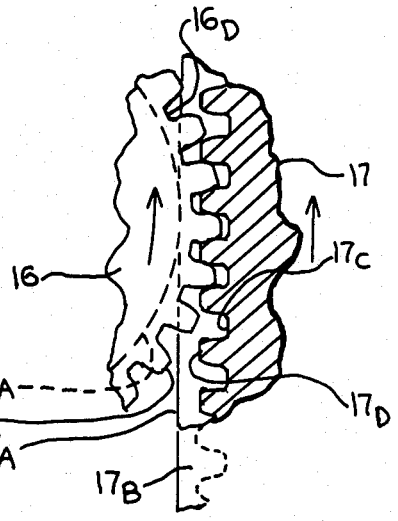

FIG. 6 is an enlarged fragmentary side view, in section, showing details of the meshed gears.

Figure 7:
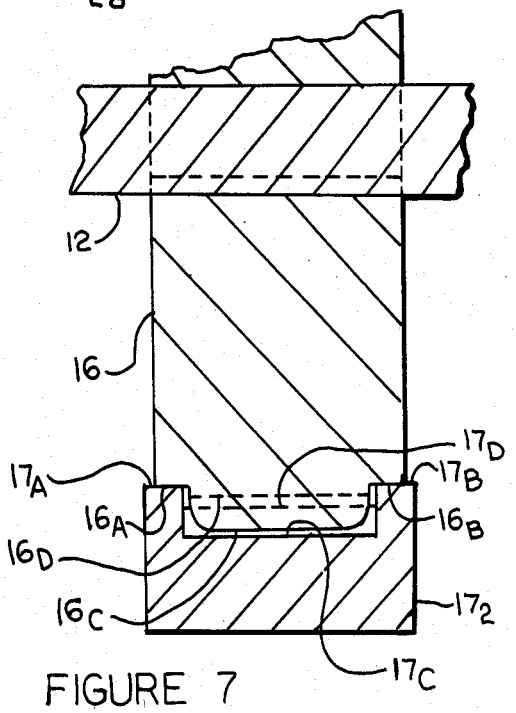

FIG. 7 is an enlarged fragmentary frontal view, in section, showing details of the meshed gears; this view being complementary to that depicted in FIG. 6.

FIGS. 8–13 include a fragmentary view of a rack and pinion type mechanism, a slide actuated mechanism and other alternate and preferred types of mechanism, for actuation and operation of the cam-camshaft activated inlet valve sub-assembly for cylinder.

Figure 1:
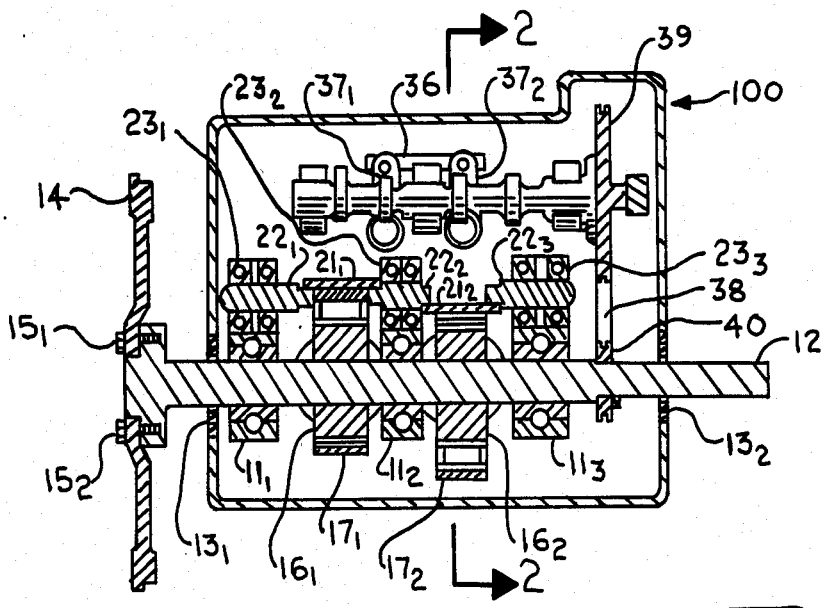
FIG. 1 is a bottom plan view, in section (taken along line 1—1 of FIG. 2), of an engine embodying the novel, and preferred features of this invention.

Referring to FIG. 1, first generally, there is depicted a preferred type of internal combustion engine 100 inclusive of cylinder block 101 (FIG. 2) within which is supported, and rotatably mounted within ball bearing mounts $\mathbf{11_1}$, $\mathbf{11_2}$, $\mathbf{11_3}$ a main gear shaft 12, output or drive shaft. Like the crankshaft of the conventional engine, the main gear shaft 12, or drive shaft converts the reciprocating motion of the pistons into rotary motion. The main gear shaft 12 is sealed via forward and rearward seals $\mathbf{13_1}$, $\mathbf{13_2}$, respectively, within the gear casing, a portion of the cylinder block 101 located below the cylinder bores. On the forward end of the main gear shaft 12 there is mounted a flywheel 14, the flywheel 14 being bolted to a hub flange portion of the main gear shaft 12 via flywheel bolts $\mathbf{15_1}$, $\mathbf{15_2}$.

The main gear shaft 12, like the conventional crank shaft is rotated and driven by power applied by the piston, or pistons, of the reciprocating piston engine 100 the gear mechanism by virtue of which the piston, or pistons, of the engine transmits this power being a key and novel feature of this invention. The main gear shaft 12 is provided with roller gears or roller gear pinions $\mathbf{16_1}$, $\mathbf{16_2}$ concentrically mounted, integral with, and keyed to the main gear shaft 12. The roller gear pinions $\mathbf{16_1}$, $\mathbf{16_2}$ are each, in turn, operatively engaged to an elongated roller gear $\mathbf{17_1}$, $\mathbf{17_2}$, each of which in turn is operatively engaged with the head of a piston and acutatable thereby as the piston is reciprocated within its respective cylinder. The engine is provided with a series of spaced-apart, in-line guide bar roller shafts $\mathbf{22_1}$, $22_2$, $22_3$. Each of the guide bar roller shafts $22_1$, $22_2$, $22_3$ are mounted in bearings $23_1$, $23_2$, $23_3$. The bearing mounts $23_1$, $23_2$, $23_3$ are affixed upon a support 7 which is welded to the cylinder block 101. Each roller guide bar shaft $22_1$, $22_3$ is constituted of a large diameter side which is set within the bearing mounts $23_1$, $23_3$ and the smaller diameter projecting ends are each faced inwardly, while roller guide bar shaft $22_2$ is constituted of a large diameter mid-portion and two smaller diameter projecting ends, each of which are faced toward the small diameter projecting ends of guide bar roller shafts $22_1$, $22_3$. A face of each of the elongated roller gears $17_1$, $17_2$ is provided with guide bars $21_1$, $21_2$ which roll around the paired small diameter ends of the guide bar roller shafts $22_1$, $22_2$ and $22_2$, $22_3$, respectively, such that on an outstroke of a piston a guide bar, e.g., $21_2$, will move along the inside of the smaller diameter ends of the pair of guide rollers, e.g., $22_2$, $22_3$, and on an instroke of a piston a guide bar, e.g., $21_1$, will move along the outside of the smaller diameter ends of the pair of guide rollers, e.g., $22_1$, $22_2$. An elongated roller gear 17 will thus be guided through a path which will maintain continuous engagement between said elongated roller gear 17 and a roller gear pinion 16 as a piston is reciprocated within its respective cylinder.

Vertical cylinders 20, one of which is shown in cross-section in FIG. 2, are openings of circular cross section that extend through the upper portion of the cylinder block 101. The interior walls of the precision bearing surfaces. Some engines are air cooled, and some are provided with surrounding jackets through which water can be circulated to remove heat and keep the engine at a proper operating temperature. The engine depicted is air cooled, and the cylinder 20 is provided with external cooling fins to maintain the desired operating temperature. Both types of engine per se are well known, and the construction of either or both are well known in the art.

Continuing the general reference to FIG. 2, a combustible mixture of fuel and air can, e.g., be drawn into a vertical cylinder 20 from a carburator 10 via the intake valve 26 due to the vacuum created in the top of the cylinder 20 by the downward movement of the piston 19. The intake valve 26, of which there is one for each cylinder, is opened and closed in a timed sequence at any given setting via the action of a rotating cam shaft 27.

The amount of said mixture of fuel and air drawn from the carburator 10 into the cylinder 20 during the fuel intake portion of an operating cycle is preselected and metered into the cylinder 20 by the cam-camshaft actuated intake valve sub-assembly. Reference is made to FIGS. 2, 2B, 3, (3A), 4, (4A), and 5. In general, the cam-camshaft acutated intake valve sub-assembly is constituted of a conventional camshaft 27, cam follower 28, and push rod 29. A terminal end of the push rod 29, a major portion of which extends upwardly through the push rod tube 34, rests within a concave opening within the top portion of the cam follower 28 providing a loose fit such that the push rod 29 is, in effect, pivotally movable within said concave opening. The opposite terminal end of the push rod 29 is, in conventional manner, operatively connected to one end of a rocker arm 30, the latter being pivotally connected via a rocker arm shaft 31 to the wall of the head. The opposite end of the rocker arm 30 is provided with a conventional valve clearance adjusting mechanism (not detailed), inclusive of an adjustment screw an end of which can operatively contact a poppet valve stem 24, spring biased via the upward push of the helical spring 32 against a keeper (not shown) to form an intake valve 26.

The amount o air-fuel intake as well as the compression ratio of the cylinder-piston units can be regulated, or controlled, by the intake valve eccentric 33. The intake valve eccentric 33 per se is characterized as a cylindrical shaped member through which an opening, the axis of which is offset from the central axis thereof, is drilled. The cylindrical shaped member 33 is contained within a tubular shaped housing 102 rigidly mounted within the cylinder block 101 and surrounding the cam follower 28. An arm 37 is secured to an upper portion of the eccentric 33, the arm 37 extending perpendicalarly outwardly over the upper edge of the wall of the housing 102 at the junction of the seal 9 located between the push rod tube 34 and the top of the eccentric 33. The upper portion of the cam follower 28, with which the push rod 29 is operatively associated, extends upwardly into the opening within the eccentric 33 within which it is reciprocable and its lower larger diameter end is located outside, and below the eccentric 33. The cam follower 28 is movable upwardly within the eccentric 33 to the point that the large diameter end thereof comes into contact with the wall formed by the opening through the eccentric 33. The cam follower 28 can move downwardly to the point wherein it physically contacts the retainer, or stop 35. As shown in FIG. 2, the cam follower 28 is arranged to an advanced position to the side of the cam lobe travel. It is held in position by the cam follower eccentric 33. An eccentric arm, $37_2$ is provided and bolted to the eccentric 33 so that the latter can be rotated. By rotating the eccentric 33 the cam follower 28 can be advanced or retarded over the cam 27*a* to speed up or slow down the engine by holding open the intake valve 26 or sharply closing it. Two cylinders and two intake valves can be conveniently tied together with an eccentric tie bar 36, in which both cylinders are controlled uniformly. This allows engine speed control without changing the carburator air-fuel mixture. Constant changing of the air-fuel mixture, as in city driving, is the main reason for polution and poor engine efficiency of the automobile.

Proper valve clearances are necessary in reciprocating type engines. When the eccentric 33 is rotated, it moves the bottom of the push rod 29 in a true circle. This circle is the base of a cone, of which the side is scribed by the push rod 29, and the apex is the point of contact between push rod 29 and rocker arm 30. Therefore, when the eccentric 33 is rotated, it does not change valve clearances.

In operation, generally, the lobe portion of cam $27_a$, located on cam shaft 27, pushes against and actuates, on rotation, the cam follower 28, which through operative engagement with the valve push rod 29 pushes down the poppet valve stem 24 of the intake valve 26 to open said valve. As the cam $27_a$ of the cam shaft 27, on rotation, pushes against the bottom of the cam follower 28 the push rod 29 is pushed upwardly away from the stop or retainer 35, the terminal end of the push rod 29, which is in contact with the rocker arm 30 pushing the poppet valve stem 24 downwardly, compressing helical spring 32 to open the intake valve 26 and permit fuel and air intake from the carburator 10. Burned gas is similarly exhausted from each vertical cylinder 20 via in-line fuel exhaust valves (not shown), these being actuated via the cam shaft 27 in a timed sequence.

Figure 4:
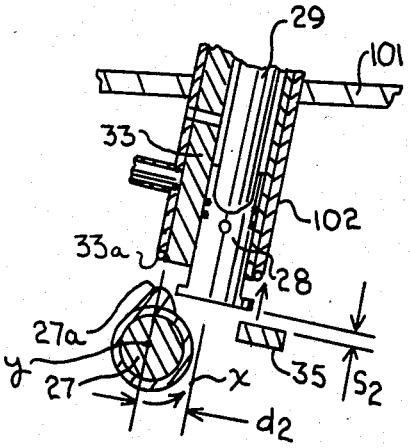
Figure 4A:
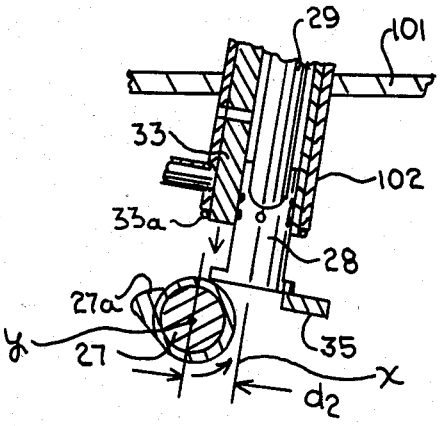
Figure 5:
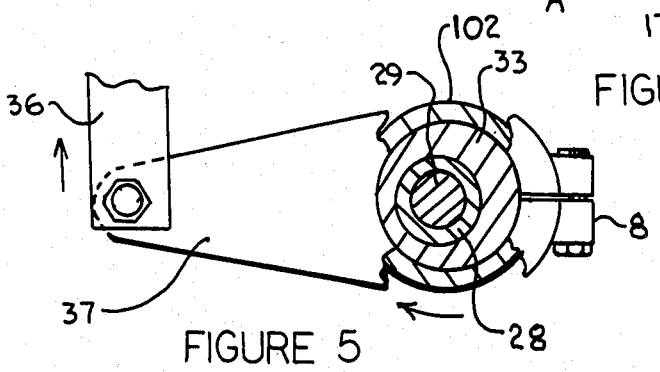

The mechanism by virtue of which the amount of fuel, or admixture of fuel and air taken into a cylinder 20 can be preselected, or adjusted, and the desired amount metered into a cylinder is described generally as follows, specific reference being made to FIGS. 3, 3A, 4, 4A, and 5. The central axis (y) of the cam shaft 27, it will be observed, is off-set from the axis (x) of the cam follower 28, and the axis (x) of the cam follower 28 is laterally shiftable toward or away from the axis (y) of the cam shaft 27 such that the distance of movement of the poppet valve stem 24 can be varied to restrict, or increase the amount of the fuel air admixture introduced into a chamber 20 via the intake valve 26. The fuel and air is metered into a cylinder 20 in relation to the setting provided via the eccentric member 33 which surrounds the cam follower 28, Rotation of the eccentric 33 around the cam follower 28 shifts the axis (x) of the cam follower 28 toward, or away from central axis (y) of the cam shaft 27 and thus decreases or increases the distance between said axes x and y; and this in turn increases or decreases the amount of fuel and air fed into a cylinder 20. In the position shown by reference to FIG. 3 the axis (x) of the cam follower 28 is relatively near to the axis (y) of the cam shaft 27, i.e., a distance "$d_1$," and consequently the cam $27_a$ on rotation of the cam shaft 27 (FIG. 3) pushes against the bottom of the cam follower 28 and moves the push rod 29 upwardly. The movement of the push rod 29 upwardly is relatively great, i.e., a distance "$S_1$," this opening the intake valve 26 relatively widely. As the cam $27_a$ passes the cam follower 28, the push rod 29 drops such that the cam follower 28 rests against the cam shaft 27 and/or retainer 35 as depicted by reference to FIG. 3A. The intake valve 26 is thereby closed. Conversely, as depicted in FIG. 4, when the eccentric 33 is moved to shift the axis (x) of the cam follower 28 to a greater distance from the axis of the cam shaft 27 (i.e., the distance is increased to "$d_2$"), the cam follower 28 is moved upwardly a lesser distance, i.e., a distance "$S_2$."Accordingly, the movement of the push rod 29 upwardly is lessened, and the downward movement of the poppet valve stem 24 is more restricted such that the intake valve 26 opens very little. Consequently, the flow of fuel and air through the intake valve 26 is more restricted than in the former case. As the cam $27_a$ passes the cam follower 28, as depicted by reference to FIG. 4A, the intake valve 26 is again closed. Between the extremes of wide open and near closure of the intake valve, many different settings can be made via rotation of the eccentric 33. It will be noted that a snap ring $33_a$ is located in a circumferential groove located in the bottom of tee eccentric 33, the snap ring $33_a$ touching the bottom portion of the housing 102. The snap ring $33_a$ prevents the eccentric 33 from moving upwardly when the cam shaft $27_a$ is rotated. A tie bar 36 mounted across the arms $37_1$, $37_2$ of a pair of eccentrics 33, as shown in FIGS. 1 and 5, produces corresponding settings between adjacent eccentrics. The relative positioning between an arm 37 and an eccentric 33 is readily adjustable via the use of a bolt clamping device 8.

Figure 8:
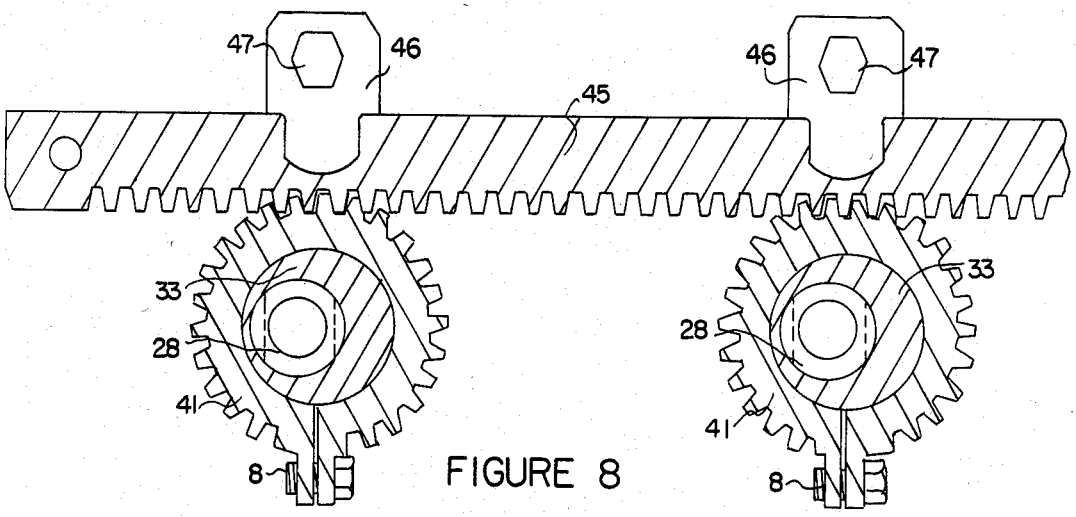
Figure 9:
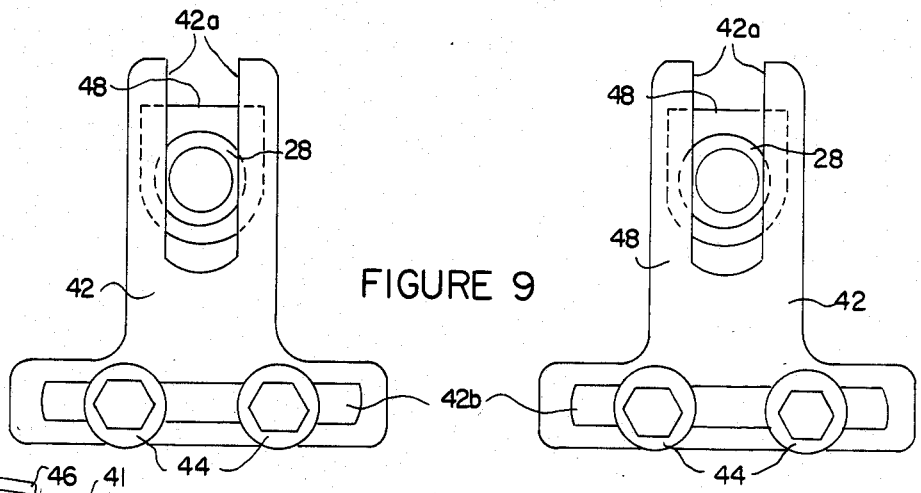
Figure 10:
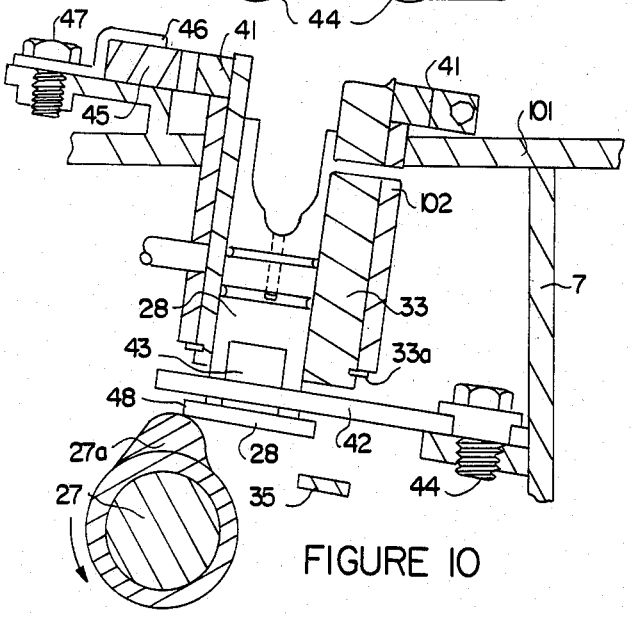

The intake valve eccentric 33 can also be actuated and moved by other means to regulate, and control the air-fuel intake to the engine. For example, as depicted by reference to FIGS. 8–11, the eccentric 33 can be driven by a rack and pinion gearing, e.g., a rack, or straight toothed member driving a pinion, or small spur gear. Referring first to FIG. 8, the eccentrics 33 of two adjacent cylinders are each concentrically mounted within an enclosing eccentric pinion gear 41, an eccentric 33 being adjustably clamped within an eccentric pinion gear 33 via a bolt 8, respectively. A gear rack 45, mechanically or manually movable, is geared to these, and one or more other gear eccentrics as may be desired, to provide an equal loading on all cylinders. The gear rack 45 is held in place by brackets 46 bolted via bolts 47 to the frame 101. Straight-line movement of the gear rack 45, in either direction, produces rotations of the eccentric pinion gear 41 in a clockwise or counter clockwise direction, respectively, as desired, and an eccentric 33 mounted therein. To utilize the full range of an eccentric 33 the straight-line movement of a gear rack 45 is sufficient to rotate an eccentric through 180°.

Figure 11:
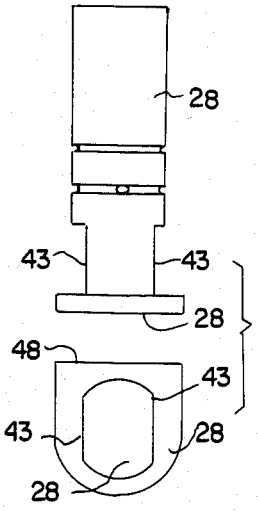

An eccentric 33 is held in place within the tubular shaped housing 102 via a snap ring $33_a$. Cam follower positioners 42, each provided with a pair of fork-like projections or fingers $42_a$ (forming a deep notch therebetween), are located below the cam followers 28. The fingers $42_a$ of a cam follower positioner 42 partially enclose, or surround the flat faces 43 of a cam follower 28 and are of sufficient length, and spaced apart sufficiently to provide a close sliding fit with the cam follower 28; this permitting vertical movement of the cam follower 28 without its rotation. A cam follower positioner 42 is held in place via attachment to the support 7 by means of a pair of step bolts 44. A pair of the step bolts 44 are extended through an elongated slot **42*b* for fastening a follower positioner 42 to the support 7. A threaded step bolt 44 is pulled down tight on its shoulder to the frame 101 but the shoulder has sufficient height to prevent clamping the follower positioner 42 so that it may slide in a close moving fit from side-to-side, the full range of the eccentric 33. The vertical distance of movement of a cam follower 28 is determined at one extreme by the stop 35, against which the cam follower 28 impinges at its point of maximum decent, at the other extreme by the lower shoulders $43_a$ of the cam follower 28 which, at the point of maximum ascent impinges against the lower face of the follower positioners 42. A preferred cam follower 28, depicted by reference to FIG. 11, is one having a trailing edge which is straight and parallel to the axis of the cam shaft 27. The straight edge 48 provides a precise cut-off of the cam follower 28 when contacted by the cam lobe $27_a$ of cam 27. Excessive wear of the cam follower 28 is avoided in that the cam follower 28 mates with the cam 27 in a single line of tangency parallel to the axis of the cam shaft 27**.

Figure 12:
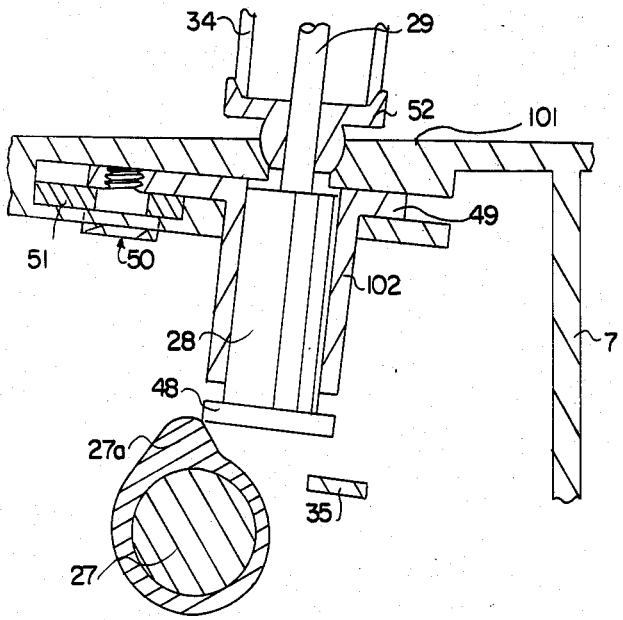
Figure 12A:
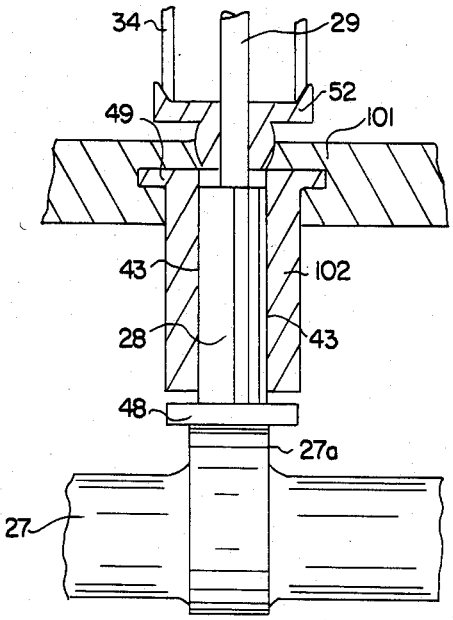
Figure 13:
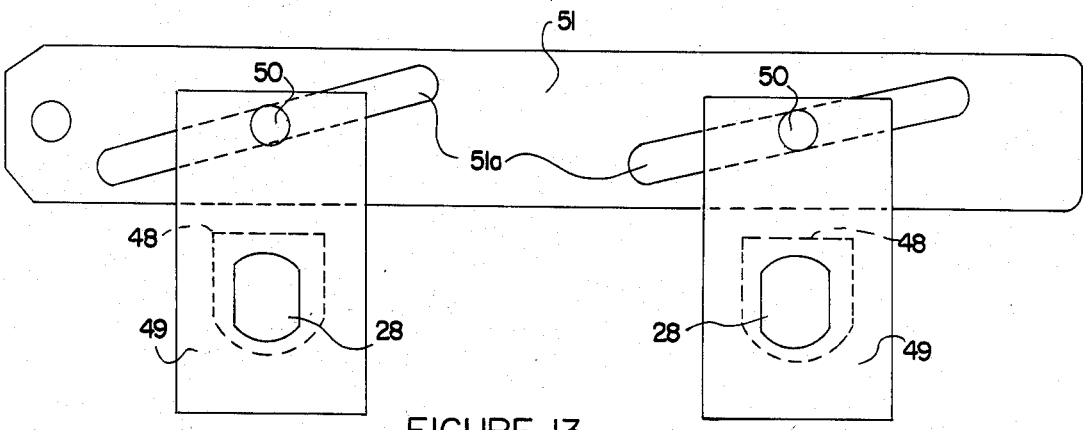

The cam follower 28 can also be actuated, and shifted via other means, e.g., the use of a slide mechanism as depicted by reference to FIGS. 12, 12A and 13. FIG. 12A depicts an end view of the structural elements shown in FIG. 12, and FIG. 13 is a plan view of the slide mechanism which produces movement of the center line of the cam follower 28 toward or away from the axis of the cam shaft 27. In this specific embodiment, a slide plate 49 provided with an upwardly, or vertically projecting post, stud, or step bolt 50, is operatively associated with each slide 49. A flat bar 51 provided with slots $51_a$, one for pairing with each slide plate 49, provides the means moving a slide plate 49. It will be observed that the bar 51, as depicted by reference to FIGS. 12, 12A and 13, is provided with a pair of diagonal slots $51_a$ and that lateral movement of bar 51 in one direction will produce equal and simultaneous movement of the slide plates 49 due to the camming action of the slots $51_a$ upon the step bolts 50; and lateral movement of the bar 51 in the opposite direction will cause equal simultaneous movement of the slide plates 49 in the opposite direction due to the camming action of slots $51_a$ upon step bolts 50, Movement of the slide plates 49 in one direction moves the central axis of the cam follower 28 toward the axis of the cam shaft 27, and movement of the slide plates 49 in the opposite direction moves the central axis of the cam follower 28 away from the axis of the cam shaft 27. The two flat sides on the cam follower 28 are mated to its slide housing 102 to prevent it from turning and to maintain the trailing straight side 48 of the cam follower 28, parallel to the cam shaft axis 27, for the purpose of providing a straight line of tangency between the wearing surfaces and a precise cut off of the cam follower 28, When the distance between the central axis of the cam follower 28 and the central axis of the cam shaft 27 is increased the intake valve of a cylinder is opened and closed over a relatively short period. Conversely, when the distance between the central axis of the cam follower 28 and the central axis of the cam shaft 27 is decreased the intake valve of a cylinder is opened and closed over a longer period. By such settings, the amount of fuel and air drawn from a carburator, or air drawn into the cylinder into which a measured amount of fuel can be injected, can be carefully regulated and controlled to optimize the ratio of fuel-to-air for maximum fuel efficiency, and emission control.

The structure, and function, of the mechanism by virtue of which power is delivered by the piston, or pistons, to the drive shaft, or main gear shaft 12 is further illustrated, and explained by continued reference to FIG. 2, and FIG. 1. As stated, the main gear shaft 12 is keyed to and integral with the roller gear pinions $16_1$, $16_2$. The roller gear pinions $16_1$, $16_2$ are, in turn, meshed with elongated roller gears $17_1$, $17_2$, respectively. The upper end of an elongated roller gear 17 is constituted of a shaft portion 173 the terminal end of which is pivotally connected via a wrist pin 18 to a piston 19, which the lower enlarged end of the elongated roller gear 17 is open centered and provided with an inside face which is aligned with teeth of size and shape to accommodate and mesh with the projecting teeth of a roller gear pinion 16. The open portion of an elongated roller gear 17, or portion thereof which accommodates a roller gear pinion 16, is longer than it is wide. Each open end of an elongated roller gear 17 is of truly semi-circular shape, and each open end is identical in size, as well as shape. The two inside faces of the two straight sides of an elongated roller gear 17 form tangents with the two semi-circular ends, and each is parallel one side with the other. The open shape of an elongated roller gear 17 has a long diameter as well as a short diameter.

To maintain gear root clearance, each elongated roller gear 17 is also provided with a pair of roller faces, or rails, $17_A$, $17_B$, located on alternate sides of the row of teeth provided thereon, and the roller faces, or rails thereof are in continuous rolling contact with a pair of roller faces, or rollers, $16_A$, $16_B$, located on alternate sides of a roller gear pinion 16 with which an elongated roller gear is paired. Referring for convenience to FIGS. 6 and 7, rails $17_A$, $17_B$ are alternately positioned on each side of the teeth $17_D$ of an elongated roller gear 17, rest against ride upon and remain in continuous contact with rollers $16_A$, $16_B$ one on each side of and constitute a part of a roller gear pinion 16. The rails $17_A$, $17_B$ are congruent to both the long and short gear pitch circle configurations of the elongated roller gear $17_2$ and can be of smaller or larger diameter than the gear pitch circle. The gear root clearance is best shown by reference to FIG. 7, this figure showing the highest points of projection of the teeth $17_D$ (and trough portion $17_C$) of an elongated roller gear 17, and highest points of projection of the teeth $16_C$ (and trough portion $16_D$) of a roller gear pinion 16. A roller gear pinion 16 is similar to a standard gear with two important exceptions: (1) it is integrally built with said rollers $16_A$, $16_B$ which mate with and roll along the rails $17_A$, $17_B$ of the elongated gear rollers 17 to preserve indispensable gear tooth clearances, and (2) one-half of the total number of teeth $16_C$, or the teeth on one side of a roller gear pinion 16, are milled to mate with the teeth on the straight sides of an elongated roller gear 17, while the other one-half of the total number of teeth are milled to mate with the alternately disposed teeth of the semi-circular ends of the elongated roller gear 17 to reduce back lash and maintain the correct pressure angle of the gears. Inward and outward movement of an elongated roller gear 17, in a manner subsequently described in detail, by movement of a piston 19 within a cylinder 20 can thus produce rotation of a roller gear pinion 16, and this in turn can produce rotation of the main gear shaft 12. The elongated roller gear 17 is, in structure and function, a means for transferring the force exerted by a piston 19 to a roller gear pinion 16; the main gear shaft 12 being driven by said elongated roller gear-roller gear pinion combination, with power being applied upon the elongated roller gear 17 by action of a piston 19 operating within a cylinder 20.

An outer face of each of the elongated roller gears $17_1$, $17_2$ carries a guide bar $21_1$, $21_2$ which, on upward movement of an elongated roller gear 17, passes along the outside of a pair of adjacently disposed guide rollers, and, on downward movement of an elongated roller gear 17, passes along the inside of a pair of adjacently disposed guide rollers of guide bar roller shafts $22_1$, $22_2$, $22_3$ to forcibly produce meshing between the teeth on the inner face of the elongated roller gears 17 and the teeth of the roller gear pinions 16. Referring first to FIG. 1, it is shown that the guide bar 211 of the elongated roller gear 171 rests against the outside face of tee relatively small diameter projecting ends of a pair of the guide bar roller shafts $22_1$, $22_2$, while the guide bar $21_2$ of the elongated roller gear $17_2$ rests against the inside face of the relatively small diameter projecting ends of a pair of the guide bar roller shafts $22_2$, $22_3$.

On downward movement of a piston 19, e.g., as occurs during an intake stroke or a power stroke, a best depicted by reference to FIG. 2, a guide bar $21_2$ rides on the inside faces of guide bar roller shafts $22_2$, $22_3$ this action holding the teeth inside face $17_{2a}$ of the elongated roller gear $17_2$ in meshed engagement with the teeth of a roller gear pinion $16_2$. Downward movement of the piston 19, and the elongated roller gear $17_2$ thus produces counterclockwise (FIG. 2) rotation of the main gear shaft 12. Near the bottom of the outstroke of piston 19, the flywheel force carried by the rotating main gear shaft 12 pushes, or thrusts the elongated roller gear $17_2$ outwardly causing the upper end of the guide bar $21_2$ to ride under and around the lower smaller diameter ends of guide bar roller shafts $22_2$, $22_3$, the upper end of the guide bar $21_2$ then moving upwardly around the guide bar roller shafts $22_2$, $22_3$ to move the elongated roller gear $17_2$ to the left to maintain engagement between the teeth of the roller gear pinion $16_2$ and the teeth of the elongated roller gear $17_2$, as the contact and meshing engagement between the teeth of the roller gear pinion $16_2$ and teeth of the elongated roller gear $17_2$ are continued on through the upper semi-circular end of the elongated roller gear $17_2$ and onward to the opposite side $17_{2b}$ of the elongated roller gear $17_2$ The operation and function of the mechanism wherein the main gear shaft 12 is rotated via action of a piston driven elongated roller gear 17, to rotate the main gear shaft 12 via action upon a roller gear pinion 16 to which the main gear shaft 12 is coupled, and the manner in which an elongated roller gear 17 is operatively engaged with a roller gear pinion 16 can best be described by continued reference to FIG. 2 and to the sequence of added operating functions demonstrated by reference to FIGS. 2A, 2B, and 2C. Thus, near completion of the outstroke, e.g., an intake stroke described by reference to FIG. 2, the upper end of the guide bar $21_2$ rides under the guide bar roller shaft $22_3$ (and $22_2$), and is thrust outwardly by the flywheel force of the revolving main drive shaft 12, the teeth of the elongated gear $17_2$ and teeth of the roller gear pinion $16_2$ remaining in continuous meshing engagement as movement between these members is continued onward through the upper semi-circular end of the elongated roller gear $17_2$ (FIG. 2A) and on to the opposite side $17_{2b}$ of the elongated roller gear $17_2$, as shown by reference to FIG. 2B. The guide bar $21_2$ then continues upwardly on the outside of the guide bar roller shaft $22_3$, the elongated roller gear $17_2$ being moved upwardly via the force of the rotating main gear shaft 12 to which it is geared via roller gear pinion $16_2$ to produce, e.g., a compression stroke.

Near the top of the stroke, e.g., on completion of a compression stroke as described in FIG. 2C, the bottom end of the guide bar $21_2$ rides over the top of the guide bar roller shaft $22_3$ due to the flywheel force produced by rotation of the main gear shaft 12. This movement, such as would occur during transition from a compression stroke to a power stroke, produces engagement between the teeth of the straight side $17_{2a}$ of elongated roller gear 17 and roller gear pinion $16_2$, and continued engagement and contact between the teeth in the straight side $17_{2a}$ of elongated roller gear 17 and roller gear pinion $16_2$ as the outstroke is continued as depicted in FIG. 2.

Near the bottom of the power stroke, preparation is made for the exhaust stroke. The exhaust stroke begins on completion of the power stroke by the top of the guide bar $21_2$ again rolling under, moving around, and then moving upwardly on the outside of the guide bar roller shaft $22_3$ as depicted by reference to FIG. 2A. As this occurs, the teeth of the elongated roller gear $17_2$ within the upper semi-circular portion of the elongated roller gear $17_2$ mesh with the teeth of the roller gear pinion $16_2$, and then with the straight inside face $17_{2b}$ of the elongated roller gear $17_2$, the latter being aided by the flywheel force produced by rotation of main gear shaft 12. Continued upward movement of the piston 19 exhaust the burnt gas from the cylinder 20 through an open exhaust valve (not shown). On completion of the exhaust stroke, the lower portion of the guide bar $21_2$ again rolls over, moves around, and then downwardly inside the guide bar roller shaft $22_3$ to begin the intake stroke, i.e., begin a new cycle of operation as described by reference to FIG. 2, and FIGS. 2A, 2B, 2C.

To summarize, on downward movement of an elongated roller gear $17_1$, $17_2$, the guide bars $21_1$, $21_2$ carried by the elongated roller gears $17_1$, $17_2$, respectively, will pass along the inside face of the guide bar roller shafts $22_1$, $22_2$, $22_3$ to guide and maintain a face of the elongated roller gear $17_1$, $17_2$ into continuous meshing engagement with the roller gear pinions $16_1$, $16_2$; this occurring, e.g., during an intake stroke and a power stroke. Conversely, on upward movement of the elongated roller gears $17_1$, $17_2$ the guide bars $21_1$, $21_2$, pass on the opposite side of guide bar roller shafts $22_1$, $22_2$, $22_3$, this causing the teeth, on the opposite face of the elongated roller gears $17_1$, $17_2$ to mesh with the teeth on the opposite face of the roller gear pinions $16_1$, $16_2$. Thus, the elongated roller gears $17_1$, $17_2$ are guided about a continuous roller path in their upward and downward movement to maintain contiuous rolling contact, and meshing engagement between an inner face of the elongated roller gears $17_1$, $17_2$ and the teeth of roller gear pinions $16_1$, $16_2$, such that upward and downward movement of the elongated roller gears $17_1$, $17_2$ are in harmony with the direction of rotation of the main gear shaft 12. The power stroke applies a force to the main gear shaft 12 with respect to a given cylinder, and the momentum of the main gear shaft 12, and firings in other cylinders, are synchronized to provide the intake, compression, power, and exhaust strokes which occur within the several operating cylinders of the engine. Synchronization between the cam shaft 27 and the main gear shaft 12 is provided by the timing chain 38 which is mounted upon the large timing sprocket 39 which drives the cam shaft 27, and the small diameter sprocket 40 which is in turn concentrically mounted upon the main gear shaft 12.

The mechanism wherein power is applied via a piston through the elongated roller gear 17-roller gear pinion 16 mechanism to a shaft, as practiced in accordance with this invention, provides a number of advantages over the conventional mechanism wherein power is applied via a piston to a crank shaft. One advantage is that the entire length of a long small diameter cylinder can be utilized without the use of a cross-head. Moreover, a considerably longer piston stroke is possible since the relatively long side to side throw required for the operation of a crank is eliminated, and whatever the length of the stroke there is no need for the use of a cross-head. For example, when the short pitch circle diameter is 5 inches, and the number of teeth contained on the elongated roller gear 17 is twice the number of teeth contained on the roller gear pinion 16, then when a gear circle pitch diameter is compared to the scribed crank pin circle of equal diameter, the piston stroke travel is 1.4188 times the pitch circle diameter. If the circle pitch diameter of a roller gear pinion is 3.995" the length of stroke is 5.668", then the advantage is a 1.673" longer stroke than in the crank shaft type engine.

A further advantage of the roller gear arrangement of this invention over the crank is that the roller gear arrangement will increase the drive shaft torque more than a crank with any given load applied to the crown of a piston, It is a relatively simple matter to produce double the torque in pound feet with any given load on a piston because the work load is applied on the tangent of the roller gear pinion 16.

The r.p.m. ratio of the drive shaft to the distance of travel of the piston can be readily controlled, or set, by changing the pitch diameters and size of the gear components. For example, the shaft roller gear pinion pitch diameter might be privided with a number of gear teeth corresponding to one unit of a given numerical value and the pitch diameter of the elongated roller gear provided with a number of teeth corresponding to two units of a given numerical unit value. Then each upward and downward motion, or cycle, of a piston would produce two revolutions of the drive shaft. If, on the other hand, the roller gear pinion were reduced to contain one-half the number of teeth while the elongated roller gear contained the same number of gear teeth, then for each piston cycle, four revolutions of the drive shaft would be produced. In the embodiment described by reference to FIG. 2, for example, the number of teeth contained on an elongated roller gear is twice the number of teeth contained on a roller gear pinion. In such embodiment, the piston after it has travelled about one-half way down the cyclinder, the intake valve will close. Consequently, at this moment in time the length of the fuel intake stroke is equal to the full downward distance of travel of a crank in a conventional engine having a crank of diameter corresponding to that of the roller gear pinion. On travelling downwardly beyond that point, in the embodiment described therein, a deep vacuum is created with the remainder of the intake stroke which further mixes the air-gas mixture. Power loss of the vacuum stroke is regained on the following compression stroke. The stroke length of a piston in a power stroke operation as described therein is thus double that of a standard engine and has double expansion allowing more complete burning of fuel. This reduces hydrocarbon polution and increases engine efficiency. Due to decreased exhaust pressure, early opening of the exhaust valve can be reduced to further increase efficiency.

It has been shown that by moving the cam follower eccentric arm it will control the cut-off point of the intake valve in a timed sequence at any desired point the piston may be, in its cylinder out stroke, and if the point is fifty percent of the piston travel, the cylinder is half charged and the remaining one-half stroke of the piston will create a vacuum. Likewise, if the intake valve cut off is three-fourths piston stroke, the cylinder will be seventy-five percent charged, with a twenty-five percent vacuum stroke. On the compression stroke of the piston the compression ratio will vary in the same way, depending on the amount of cylinder charge. On the power stroke the cylinder charge will burn and expand in the normal way except that it will further burn and expand on the piston stroke previously described as a vacuum in the intake stroke, producing useful work and reducing hydrocarbon exhaust. When the cylinder is charged with air pulled through a carburator with a set fuel-air ratio, the speed of the engine can be controlled by movement of the eccentric without further adjustment to the fuel-air ratio of the carburator because the quantity of the mixture is increased or decreased within the cylinder. A longer piston stroke extends the workability of the combination. The same burning and expansion will occur in a cylinder in which the fuel has been injected.

The intake of a cylinder is an admixture of fuel and air, as from a carburator, or the fuel can be separately injected into a cylinder from an injector, or injectors, and therein admixed with air previously drawn into the engine via the intake valve from tee piston intake stroke. The use of a carburator is limited and can be used only with volatile fuels on a low compression engine. In accordance with this invention the double length piston stroke, as contrasted with that of a low compression engine with a short stroke, increases the cylinder intake, and consequently greater pressure and heat from compression. To prevent pre-ignition, the mixture of gasoline and air from a carburator compressed by a piston within a cylinder, must be avoided when the compression pressure exceeds that of a low compression engine. Therefore, the injector is relied upon to supply an accurately measured preselected amount of fuel to each cylinder.

Detonation and knocking from increased cylinder compression is prevented in the usual way, through the blending of hydrocarbon compounds in the fuel. The increased density of fuel being injected in the combustion chamber and ignited along the flame front will also prevent detonation and associated knocking.

The engine can quite readily produce pressures ranging generally from about 110 psi to about 500 psi. The carburator is quite reliable for the introduction of fuel and air into engines operated at pressures below about 150 psi. On the other hand, e.g,, a low pressure of about 350 psi and a high pressure of about 500 psi is generally employed for diesel engines. In the operation of diesel engines at these higher pressures, air is preferably admitted into and compressed in a cylinder, and the fuel is supplied thereto by an injector. In low pressure operations, as in conventional gasoline engines, the carburated mixture of fuel and air is ignited with a spark plug (not shown). In higher pressure operations, as in higher pressure diesel operation, the combustible mixture may be self-ignited; and, in some instances, a spark plug can be employed for ignition or assuance of ignition of middle distillate fuels, or admixtures thereof with gasoline.

For maximum utility of this invention, a selected measured quantity of air is drawn through the varable controlled intake valve and compressed within the cylinder or cylinders. Conventional injectors and nozzles are provided (not shown) to provide a proportional measured amount of fuel in the form of an atomized spray into each cylinder. The injection is timed and carried out when the piston is on top dead center or a few degrees before top dead center. When the selected measured quantity of air intake is not sufficient to provide compression pressure of approximately 350 psi or more, the air and fuel mix will not self-ignite at the time of injection, so a spark plug (not shown) is provided and relied upon to provide ignition. This assures a unified internal combustion engine.

It is apparent that various changes, such as the size, shape and dimension of the various components and parts can be made without departing the spirit and scope of the invention.

Having described the invention, what is claimed is:

1. In combination, apparatus comprising a piston engine wherein a piston having a crown side and a side opposite said crown side to which an end of a piston is attached while the other is operatively engaged with a drive shaft and the piston reciprocated within a cylinder to drive the engine, a fuel injector means for the introduction of fuel into the cylinder, an intake valve open to an air source such that air can be taken into the cylinder and the fuel burned, a sprocket operatively engaged with said drive shaft, a cam shaft, a sprocket operatively engaged with said cam shaft, and a timing chain operatively engaged with the sprockets of said drive shaft and said cam shaft to provide synchronization between the rotation of said drive shaft and said cam shaft during operation of the engine, a cam surface, a cam follower, an eccentric member surrounding said cam follower adjustably movable in relation therewith, and means associated with said cam follower wherein, when the eccentric member is moved to or away from the axis of the cam shaft to shift the position of the cam follower, the up and down movement and cut off point of the intake valve is effected in timed relationship with the charging of a cylinder to effectively control intake.

2. In a piston engine wherein a piston having a crown side and a side opposite said crown side to which an end of a piston is attached while the other is operatively engaged with a drive shaft and the piston reciprocated within a cylinder to drive the engine, a fuel injector means for the introduction of fuel into the cylinder, an intake valve open to an air source such that air can be taken into the cylinder and the fuel burned a sprocket operatively engaged with said drive shaft, a cam shaft, a sprocket operatively engaged with said cam shaft, and a timing chain operatively engaged with the sprockets of said drive shaft and said cam shaft to provide synchronization between the rotation of said drive shaft and said cam shaft during operation of the engine, the cam shaft further including, in combination therewith, a cam surface, a cam follower, with a push pod flexibly riding the cam follower, and surrounded with a push rod tube, and a rocker arm one end of which is operatively engaged with an end of the push rod and the other end of which moves an intake poppet valve stem downwardly within the combustion chamber to provide said intake valve inlet for the introduction, and interruption of, air into the cylinder, the improvement comprising an eccentric member located within a cylindrical bearing in the block, in which the cam follower is fitted, such that rotation of the eccentric shifts the axis of the cam follower to move it closer to, and further from, the axis of the cam shaft wherein the length of stroke of the cam follower is increased to lengthen, and decreased to shorten, the upward distance of movement of said push rod in its actuation of the rocker arm which in its effect regulated the time period, and size of the opening offered by movement of the poppet valve stem on opening said intake valve inlet and closing point cut off to meter a preselected quantity of air into the cylinder.

3. The apparatus of claim 2 wherein the eccentric member is cylindrical in shape and machined with tolerances providing a close moving fit on the outside to fit the bore provided in the engine block, with the inside drilled and machined off center with a close moving fit to that of the inserted cam follower in which the intake valve push rod is flexibly connected, such that rotation of the eccentric in one direction shifts the axis of the cam follower to move it closer to, and in the opposite direction shifts the axis of the cam follower to move it further from the axis of the cam shaft, wherein the length of stroke of the cam follower thereby regulates the size opening and cut off of the poppet intake valve at any point of travel of the piston within its cylinder on the piston intake stroke, to meter a preselected quantity of air into the cylinder.

4. The apparatus of claim 2 wherein the eccentric is provided with an arm to facilitate rotation of the eccentric for setting the amount of intake.

5. The apparatus of claim 4 wherein the eccentrics of adjacent cylinders are provided with arms, and the arms of the adjacent eccentrics pivotally secured together via a tie bar.

6. The apparatus of claim 3 wherein the eccentric is moved to shift the cam follower axis the maximum distance away from the cam shaft axis to cause the intake valve to admit a minimum charge of air into the cylinder, the compression pressure of the charge after compression within the cylinder comparing to that of a low compression engine, and thereafter the eccentric is moved to shift the axes of the cam follower and cam shaft into alignment to cause the intake valve to fully charge the cylinder with air, the compression pressure of the charge after compression comparing to that of a high compression engine.

7. The apparatus of claim 2 wherein the eccentric is provided with an arm center drilled and threaded for a bolt on one end and center drilled, machined and slitted to fit the outside diameter of the eccentric on the other end, with a bolt across the slit to form an adjustable clamp for adjusting the angle of the arm to the throw of the eccentric and when clamped in place to facilitate rotation of the eccentric for regulating the amount of cylinder intake.

8. The apparatus of claim 2 wherein the eccentric is contained within a cylindrical bearing surface in the engine block, and is machined true to a straight line passing through the center of the bearing surface and terminates in the center of the valve push rod socket of the rocker arm, such that the circular motion of the cam follower, when moved about the cam axis will form the base circle of a right cone in which the apex is centered in the rocker arm socket and the push rod scribes its sides which are equal as a consequence of which the distance between the rocket arm and cam follower is always the same and provides the means to preserve any selected intake view clearance setting when the eccentric is moved.

9. In combination, apparatus comprising a reciprocating piston engine wherein there is included the combination of one or more pistons individually reciprocably mounted each within a cylinder, an intake valve located within a cylinder through which fuel and air can be admitted into the cylinder, compressed and the fuel burned to drive a piston during a power stroke, an exhaust valve located within a cylinder through which burned fuel can be exhausted by movement of a piston to expell the burned gases during an exhaust stroke, a piston having a crown side and a side opposite said crown side to which a piston shaft is pivotally attached, the crown side of the piston facing into the cylinder wherein said intake and exhaust valves are located, an elongated roller gear to which said piston shaft is pivotally attached, the elongated roller gear is open centered and has an inside face thereof provided with a continuous array of teeth, a drive shaft, a roller gear pinion operatively engaged with said drive shaft, rotation of which produces rotation of said drive shaft, said roller gear pinion being provided with a continuous array of teeth for continuous meshing engagement with the teeth on the inside face of said elongated roller gear, movement of a piston acting through a piston shaft and elongated roller gear producing rotation of said drive shaft via action upon roller gear pinion, a pair of rails, one each of which is disposed on opposite sides of the teeth of said elongated roller gear, a pair of rollers, one each of which is disposed on opposite sides adjacent the teeth of and parallel to said roller gear pinion, the rollers of the roller gear pinion contacting and rolling along the rails of said elongated roller gear to maintain a proper relationship and root clearance between the meshing teeth of an elongated roller gear and a roller gear pinion for effecting the continuous rolling and meshing engagement, a pair of guide bar roller shafts, spaced apart, in-line and mounted in bearings upon the engine in generally parallel orientation with the drive shaft on alternately disposed sides of the elongated roller gear and roller gear pinion, a guide bar mounted on the elongated roller gear on a side thereof faced toward said pair of guide bar roller shafts, the guide bar engaging the pair of guide bar roller shafts, such that reciprocating movement of the elongated roller gear produced by reciprocation of the piston within a cylinder produces a rocking movement of the elongated roller gear through a path about which said guide bar moves around said pair of roller bar guide shafts to maintain continuous rolling and meshing contact between said elongated roller gear and roller gear pinion, and rotation of the drive shaft, a cam shaft, a sprocket operatively engaged with said cam shaft, a sprocket operatively engaged with said drive shaft, and a timing chain operatively engaged with the sprockets of said cam shaft and said drive shaft to provide synchronization between the rotation of said drive shaft and said cam shaft during operation of the engine, the cam shaft further including, in combination therewith, a cam surface, a cam follower with a push rod flexibly riding on top, and surrounded with a push rod tube, a rocker arm one end of which is operatively engaged with an end of the push rod and the other end of which moves an intake poppet valve stem to provide charging of the cylinder, and means for locating the cam follower in an advanced position relative to the cam shaft axis, and means for moving the cam follower toward and away from the cam shaft axis to control the opening and cut off of the intake valve to increase and decrease the amount of cylinder intake, in timed relation to the position of the piston within the cylinder on its out stroke, respectively.

10. The apparatus of claim 9 wherein the means which actuates and moves the cam follower in a eccentric, the eccentric is mounted within a pinion and the pinion driven by the rack, and the rack is similarly connected to another eccentric mounted within a pinion to provide an equal identical intake loading of plural cylinders, wherein the movement of the said cam follower and intake valve push rod axis will not change intake valve clearances.

11. The apparatus of claim 9 wherein the means which actuates and moves the cam follower is constituted of a slide operatively engaged with bars which are directly attached to said slide, and cam follower, and responsive thereto for movement of the cam follower.

12. The apparatus of claim 10 where the cam follower is shifted toward and away from the cam shaft axis, the cam follower has a straight side on its trailing edge which is aligned parallel to tee axis of the cam shaft for the purpose of maintaining a single straight line of tangency between the wearing surfaces of the cam follower and cam shaft lobe to prevent wear and to provide a precise cut off point of the intake valve.

13. The apparatus of claim 12 where the cam follower is provided with two parallel flat surfaces, one on each side of the stem and perpendicular to its straight trailing edge, a cam follower positioner with a fork closely spanning the flat parallel surfaces such that the cam follower can move within the fork without turning, and there is also provided a slot in the cam follower positioner where two step bolts are closely fitted to secure the cam follower positioner to the frame so that when the step bolts are tightened there is sufficient height of their shoulder to allow lateral movement of the cam follower positioner, allowing the cam follower movement toward and away from the axis of the cam shaft without the cam follower turning and thereby maintaining the straight trailing side of the cam follower parallel to the cam shaft axis.

14. The combination of claim 9 where the cam follower has been shifted or adjusted to select a cut off of the intake valve when the piston has reached a preselected point, the intake volume is accurately known and after being compressed an accurate selected amount of fuel by weight can be injected so that when ignited with a spark plug the mixture will burn clean and efficiently.

15. The combination of claim 9 where the cam follower is adjusted to cause the cut off of the intake valve when the piston has reached a preselected point within the cylinder, the selected amount of intake has occurred and the remainder of intake stroke is spent in pulling a vacuum, of which the spent energy required in doing so will be partly returned to the engine on the following compression stroke.

16. The combination of claim 9 where the cam follower has been shifted to cause the cut off of the intake valve when the piston has reached a preselected distance of travel within the cylinder, where the intake and vacuum stroke has been completed, returning part of the energy in pulling the vacuum to the engine, the compression stroke takes place, compressing only the amount of air required for complete clean combustion in operation of the engine whereby energy spent in compressing excess air is avoided.

17. The combination of claim 9 where the cam follower has been shifted to cause the cut off of the intake valve when the piston has reached a preselected distance of travel within the cylinder, with the selected measured amount of air intake, and the vacuum and compression stroke completed, conventional fuel injectors and nozzles are employed to inject an atomized spray of fuel within the cylinder in accurately measured preselected amount to provide a selected ratio by weight of about one part of fuel to fifteen parts of air, and ignited with a spark plug to provide a power stroke that burns and expands the complete length of the cylinder, including the vacuum stroke whereby the produce of expansion is utilized to maximize burning of oxygen and hydrocarbon fuel which leads to reduction in exhaust emissions of carbon monoxide and nitrous oxide.

* * * * *